US008579768B2

(12) United States Patent
Prstojevich

(10) Patent No.: US 8,579,768 B2
(45) Date of Patent: Nov. 12, 2013

(54) TRAINING LADDER FORMED WITH POLYGON SEGMENTS

(75) Inventor: Michael Prstojevich, Portland, OR (US)

(73) Assignee: Nike, Inc., Beaverton, OR (US)

( * ) Notice: Subject to any disclaimer, the term of this patent is extended or adjusted under 35 U.S.C. 154(b) by 161 days.

(21) Appl. No.: 12/117,643

(22) Filed: May 8, 2008

(65) Prior Publication Data

US 2009/0156365 A1 Jun. 18, 2009

Related U.S. Application Data

(60) Provisional application No. 60/916,801, filed on May 8, 2007.

(51) Int. Cl.
*A63B 5/00* (2006.01)

(52) U.S. Cl.
USPC ..... 482/15; 482/14; 482/16; 482/35

(58) Field of Classification Search
USPC ..... 482/35–37, 14–16; 434/247, 255; 472/36
See application file for complete search history.

(56) References Cited

U.S. PATENT DOCUMENTS

| | | | | |
|---|---|---|---|---|
| 2,956,806 | A * | 10/1960 | Routson | 482/35 |
| 3,014,723 | A | 12/1961 | Butler | |
| 3,042,400 | A | 7/1962 | O'Rear | |
| RE25,474 | E | 11/1963 | O'Rear | |
| 3,339,920 | A * | 9/1967 | Moritz | 482/34 |
| 3,515,385 | A | 6/1970 | Gunderson | |
| 3,547,444 | A | 12/1970 | Williams et al. | |
| 3,661,689 | A | 5/1972 | Spanier | |
| 3,731,445 | A | 5/1973 | Hoffman et al. | |
| 4,063,585 | A * | 12/1977 | Stanley | 160/135 |
| 4,603,853 | A * | 8/1986 | Satterthwaite | 482/35 |
| 5,203,752 | A * | 4/1993 | Frankel | 482/36 |
| 5,353,892 | A | 10/1994 | Lu | |
| 5,540,013 | A | 7/1996 | Diamond | |
| 5,906,530 | A | 5/1999 | Lindsey | |
| 6,447,427 | B1 * | 9/2002 | Myrland et al. | 482/34 |
| 7,070,541 | B2 * | 7/2006 | Madigan et al. | 482/35 |

(Continued)

FOREIGN PATENT DOCUMENTS

| | | |
|---|---|---|
| DE | 2716219 A1 | 10/1978 |
| JP | 51055759 | 4/1976 |
| JP | 60063371 | 5/1985 |
| JP | 2000-102625 | 4/2000 |

OTHER PUBLICATIONS

International Search Report; PCT app. No. PCT/US08/63125; May 8, 2008; 2 pages.

(Continued)

*Primary Examiner* — Glenn Richman
(74) *Attorney, Agent, or Firm* — Banner & Witcoff, Ltd.

(57) ABSTRACT

A training ladder formed of a plurality of substantially rigid polygon-shaped segments detachably secured together with segment connectors extending therebetween. The sides of each segment are substantially the same to allow the segment connector to join any sides between two adjacent segments. Accordingly, the path through the ladder can be varied. In one disclosed embodiment, the segments are octagon shaped and pivotally secured to the segment connectors, thereby allowing the ladder to collapse into a stack when not in use and allowing some of the segments to extend substantially vertically, thereby defining a hurdle or other possible vertical structure.

11 Claims, 8 Drawing Sheets

(56) References Cited

U.S. PATENT DOCUMENTS

| | | | | |
|---|---|---|---|---|
| 2002/0010054 | A1* | 1/2002 | Araki et al. | 482/35 |
| 2002/0050285 | A1* | 5/2002 | Zheng | 135/126 |
| 2006/0073748 | A1 | 4/2006 | Boujon | |
| 2006/0229171 | A1* | 10/2006 | Severino | 482/93 |

OTHER PUBLICATIONS

Written Opinion of the International Searching Authority; PCT app. No. PCT/US08/63125; May 8, 2008; 4 pages.

Notification of Transmittal of the International Search Report; PCT app. No. PCT/US08/63125; May 8, 2008; 1 page.

Japanese Office Action dated Aug. 21, 2012 in Japanese Patent Application No. 2010-507676 (5 pages).

Canadian Office Action dated Mar. 25, 2013 for Application No. 2,695,480 (4 pages).

European Patent Application No. 08755200 Extended European Search Report dated Dec. 23, 2011.

Office Action dated Jun. 18, 2012 for Canadian Patent Application No. 2,695,480. (3 pages).

* cited by examiner

TRAINING LADDER FORMED WITH POLYGON SEGMENTS

CROSS-REFERENCE TO RELATED APPLICATIONS

This application claims priority to U.S. provisional patent application Ser. No. 60/916,801 filed on Apr. 8, 2007.

FIELD OF THE INVENTION

The present invention relates to a training ladder used primarily for athletic events, athletic training, and the like.

BACKGROUND OF THE INVENTION

Training ladders usually have elongated, spaced apart rungs that are positioned on the ground and substantially parallel to each other. A typical training exercise using the ladder involves the athlete attempting to quickly run between the rungs without touching them with his or her feet.

Typical training ladders include a plurality of substantially rigid, elongate, rungs that are spaced apart from each other by a webbing of flexible material such as rope, nylon strips or the like. During use of these known training ladders, the rungs tend to become displaced as the athlete inadvertently contacts them or the webbing holding them apart. Accordingly, these known ladders are typically staked to the ground in an effort to keep them in place during use. These stakes tend to become lost during use and storage of the ladder.

Moreover, such staking limits the ease of use of the ladder. For example, if an athlete inadvertently positions his or her foot under the webbing while performing an exercise drill and then lifts their foot without first removing it from under the webbing, he or she can easily trip, particularly when the webbing is staked to the ground.

Also, such ladders cannot be easily reconfigured to define different training paths and the like, and they cannot be used for other purposes, such as a portable hurdle or support structure.

In addition, the webbing tends to become tangled when the ladder is collapsed and stored, thereby compromising the user's ability to easily set-up the ladder for future use.

SUMMARY OF THE INVENTION

Despite the known athletic training ladder structures, there remains a need for a training ladder that is economical to manufacture and purchase, and is easy to set-up, use, collapse, and store without necessarily requiring the user to stake the ladder to the ground during use. In addition, there remains a need for a ladder that allows different training paths to be configured and that can also be used as a portable hurdle, support structure, or the like. In addition to the other benefits disclosed herein, the present invention fulfills these needs.

In one disclosed embodiment, the athletic training ladder is formed of a plurality of substantially rigid polygon-shaped segments joined together by one or more segment connectors. Preferably, the sides of each segment are substantially the same to allow the segment connector to join any sides between two adjacent segments. Accordingly, the path through the ladder can be varied.

More preferably, the segments are octagon shaped, and pivotally secured to the segment connectors, thereby allowing the ladder to collapse into a stack when not in use and allowing some of the segments to extend substantially vertically, thereby defining a hurdle or other possible vertical structure.

DETAILED DESCRIPTION OF PREFERRED EMBODIMENTS

A collapsible athletic training ladder 20 having a plurality substantially rigid polygon segments 30, 30' joined together with segment connectors 32, 32' is shown in FIGS. 1-16. A first preferred embodiment is shown in FIGS. 4-10, and an alternative preferred embodiment is shown in FIGS. 1-3 and 11-16. In order to reduce undue repetition, like elements between these embodiments are like numbered.

Figure 1:
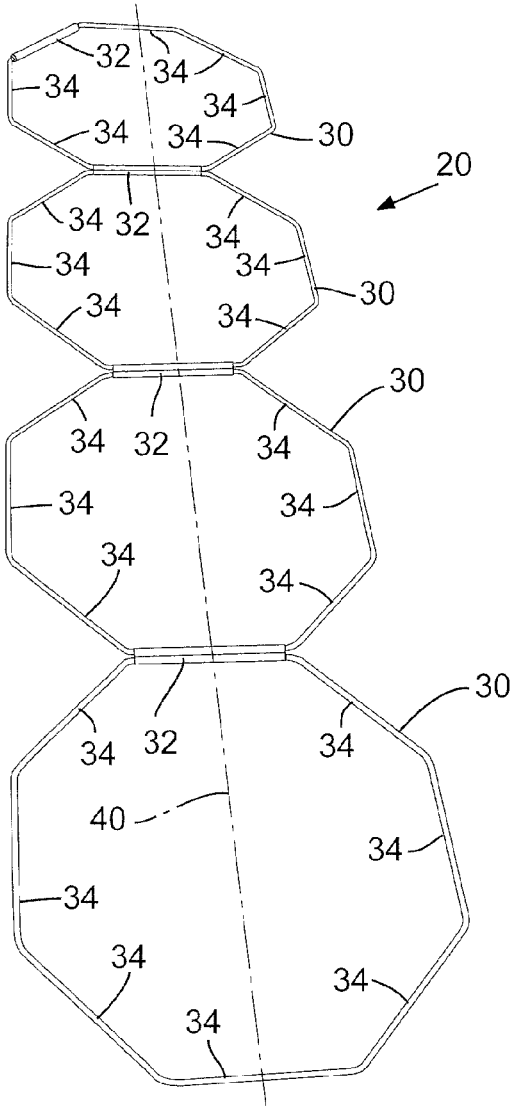
FIG. 1 is an assembled portable training ladder in accordance with an embodiment of the present invention.
Figure 2:
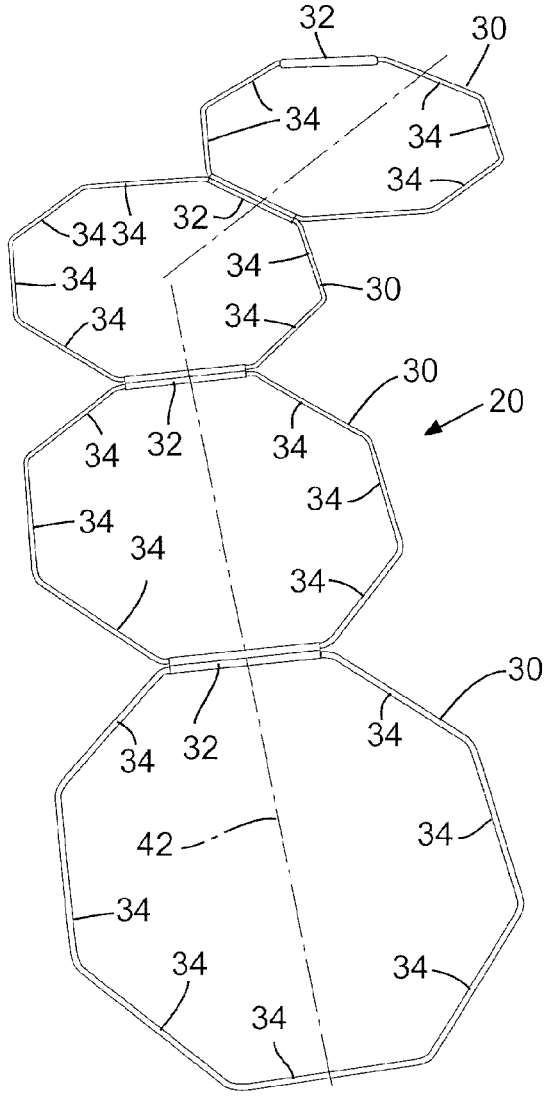
FIG. 2 is the ladder of FIG. 1 showing a possible alternative running path configuration.
Figures 11, 12:
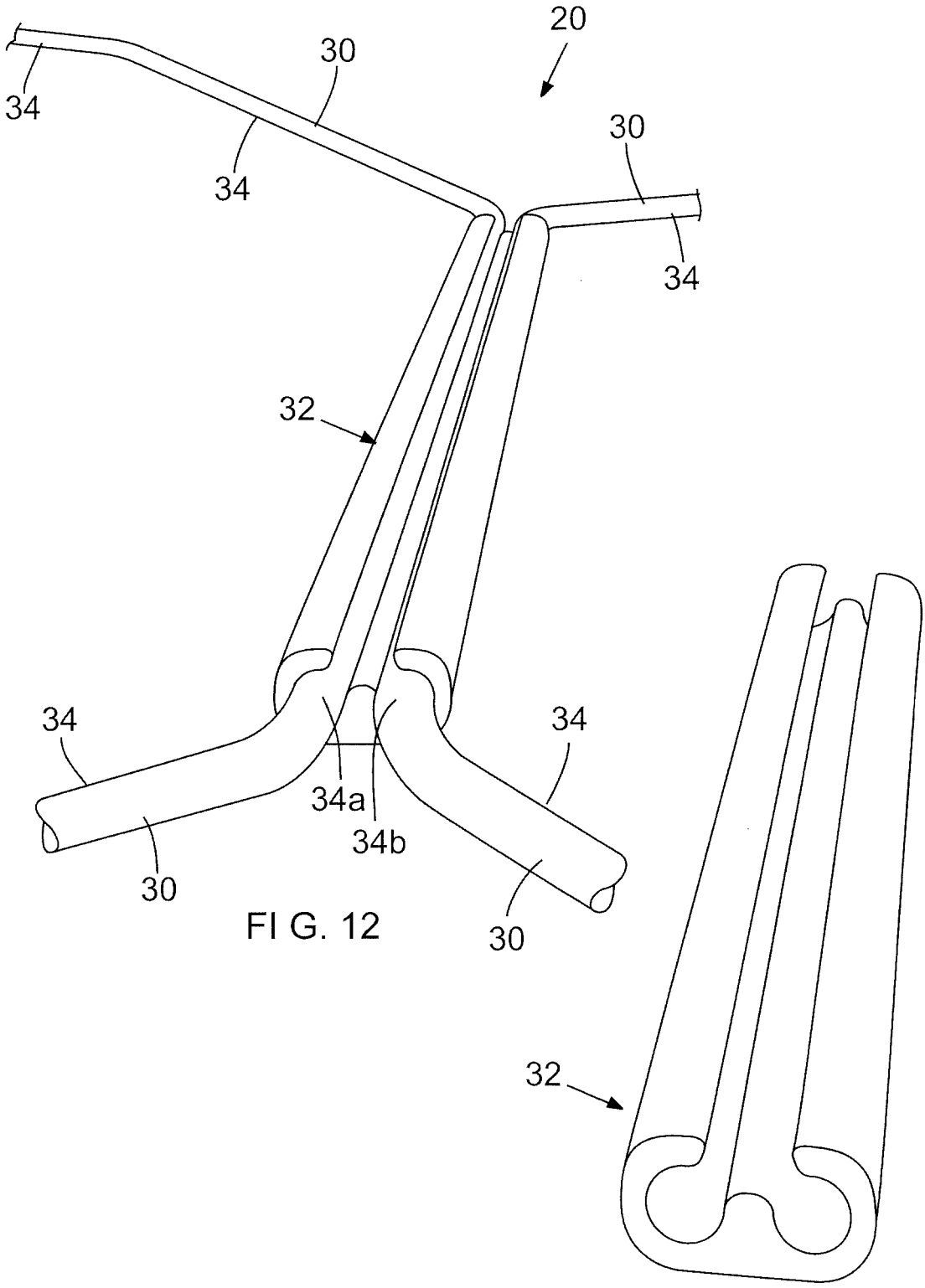
FIG. 11 is an isometric view of an alternative possible segment connector.
FIG. 12 is an enlarged view of the segment connector of FIG. 11 connecting two polygon segments in accordance with an embodiment of the present invention.

Referring to FIGS. 1-3 and 11-16, the polygon segments 30 are preferably shaped like an octagon having sides 34 of substantially the same length. The segment connector 32 (FIG. 11) is sized and shaped to detachably connect two adjacent sides 34*a*, 34*b* of different segments 30 as best shown in FIG. 12. It can be appreciated that a plurality of segments can be joined together with a plurality of segment connectors to form various running patterns. For example, FIG. 1 shows a straight running path 40, and FIG. 2 shows a modified running path 42.

Figure 13:
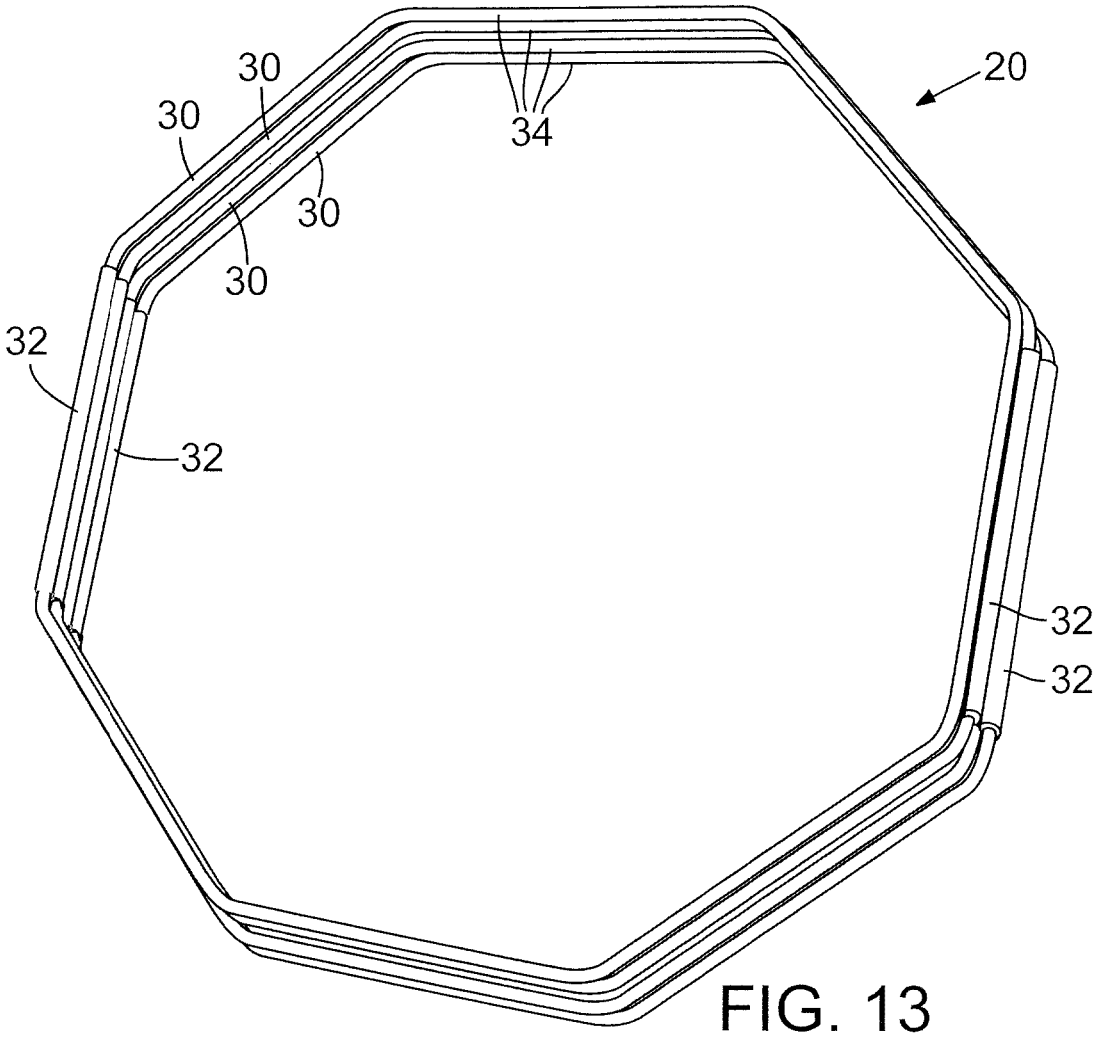
FIG. 13 is a training ladder in accordance with an embodiment of the present invention showing a possible folded-up configuration.
Figure 14:
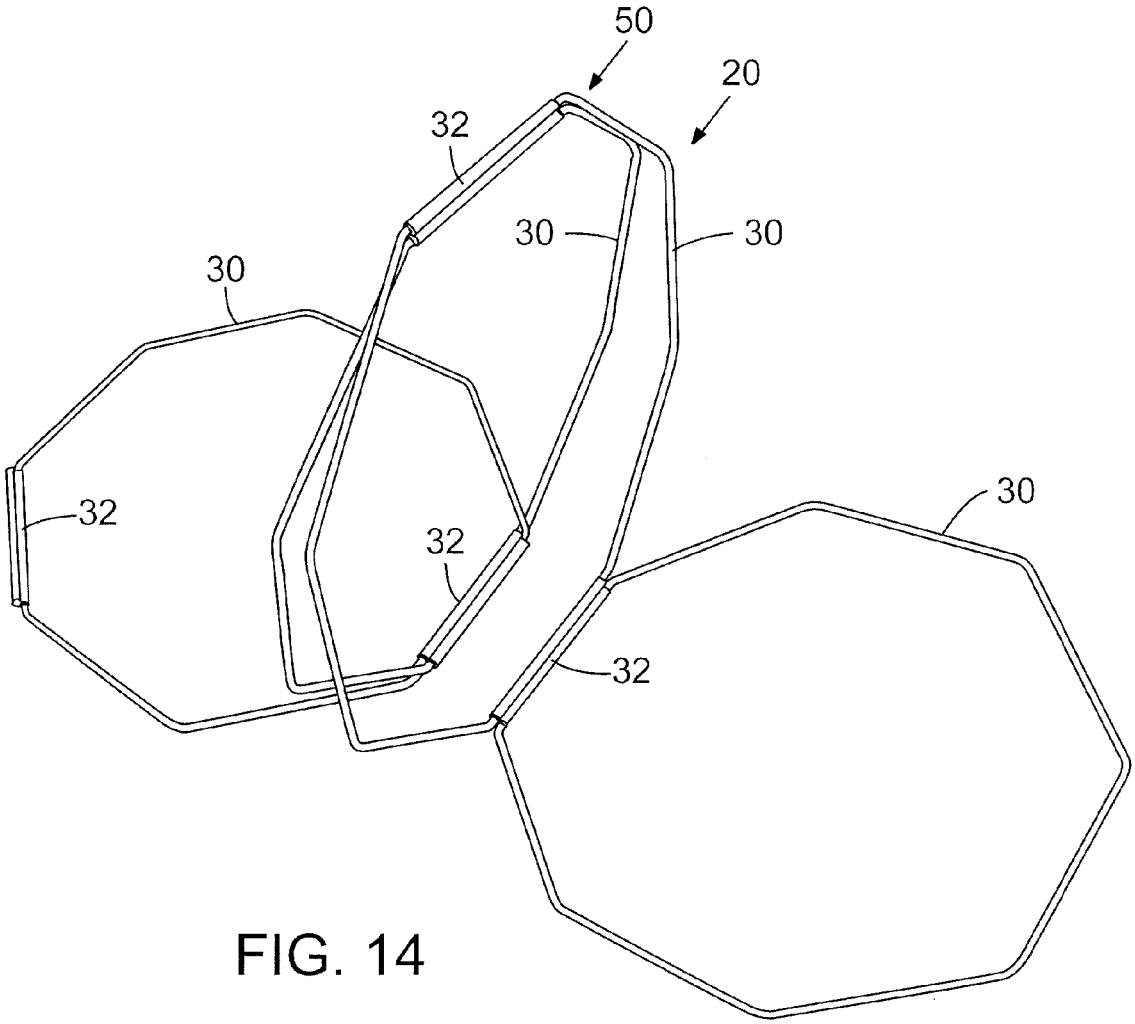
FIG. 14 is a left, rear isometric view of the training ladder of FIG. 13 showing a possible orientation has a hurdle.
Figure 15:
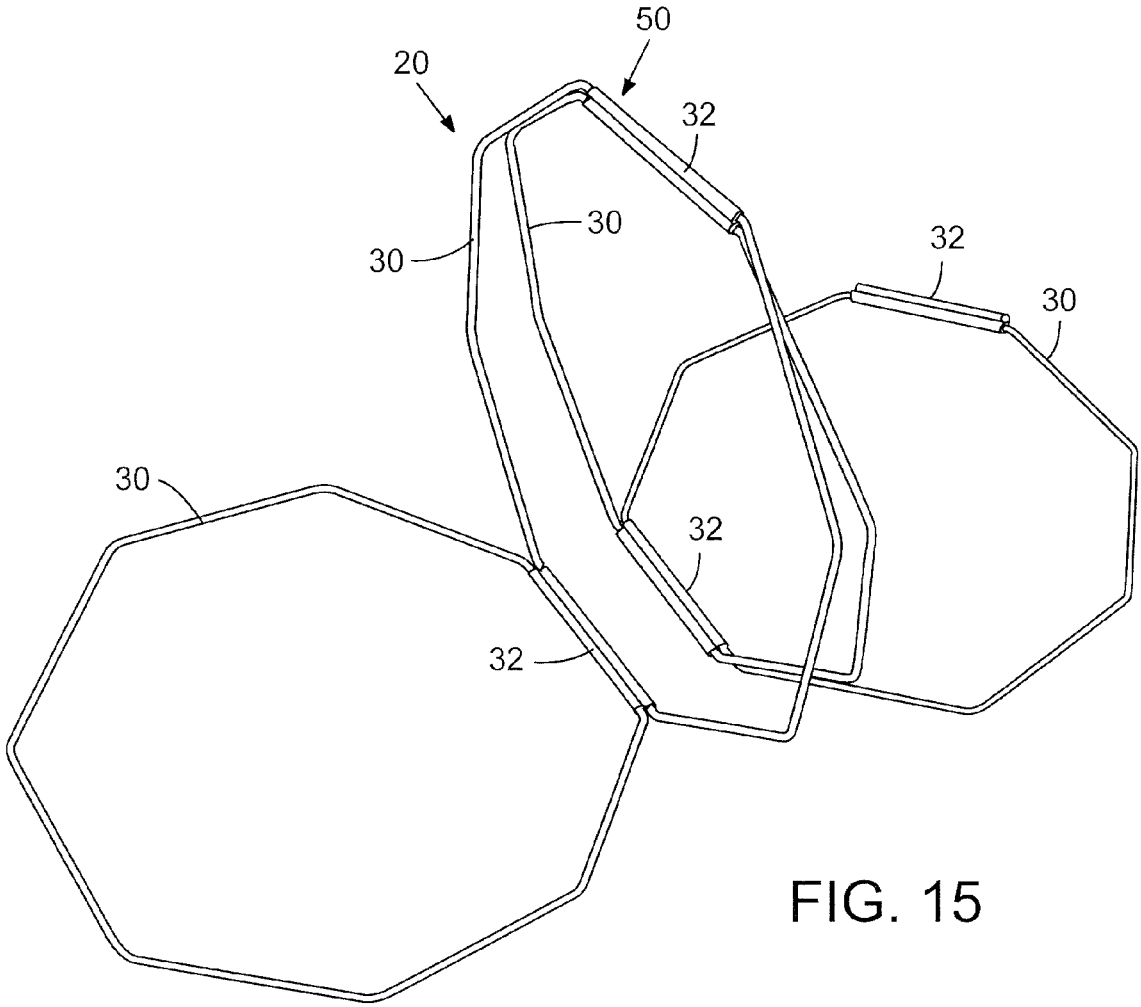
FIG. 15 is a right, rear isometric view of the training ladder of FIG. 14.
Figure 16:
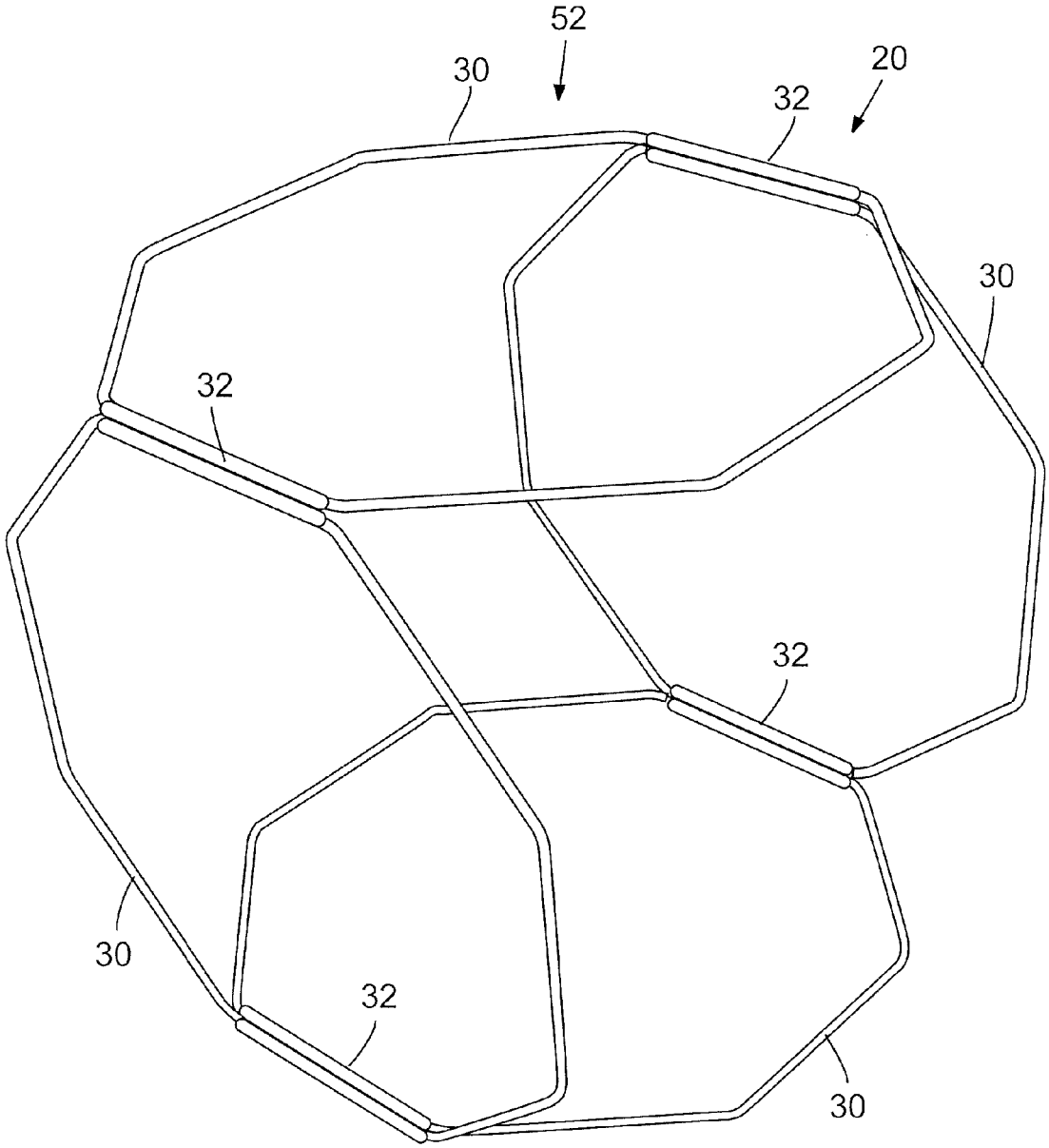
FIG. 16 is an isometric view of the ladder of FIG. 13 showing a possible configuration as a portable structure.

In addition, the segment connectors 32 can also allow the segments to pivot with respect to each other. Accordingly, the entire ladder can be collapsed for ease of transport and storage as shown in FIG. 13. Also, the various segments can pivoted with respect to each other to define a portable hurdle 50 as shown in FIGS. 14 & 15, or a portable support structure 52 such as shown in FIG. 16.

Preferably each segment 30 is formed of a light weight, substantially rigid material, such as a molded polymer, formed fiberglass rod, or the like. More preferably, each segment defines an octagon. Alternatively, different polygon shapes, such as a triangle or the like could also be used.

Referring to FIGS. 4-10, a training ladder formed of alternative preferred segments 30' is disclosed. The segments 30' are molded to define a polygon, here an octagon is shown. Recesses 60 are positioned along the sides to allow a segment connector 32' to operably engage therein.

The segment connector 32' is best shown in FIGS. 6-10. Preferably, it is integrally molded to define a first engaging portion 80 for operably engage a first segment, and a second engaging portion 82 for operably engaging a second segment, thereby joining the two segments together. The sides 34 of each segment 30' each include recesses 60 for engaging one of the engaging portions on the segment connector 32'.

Figure 3:
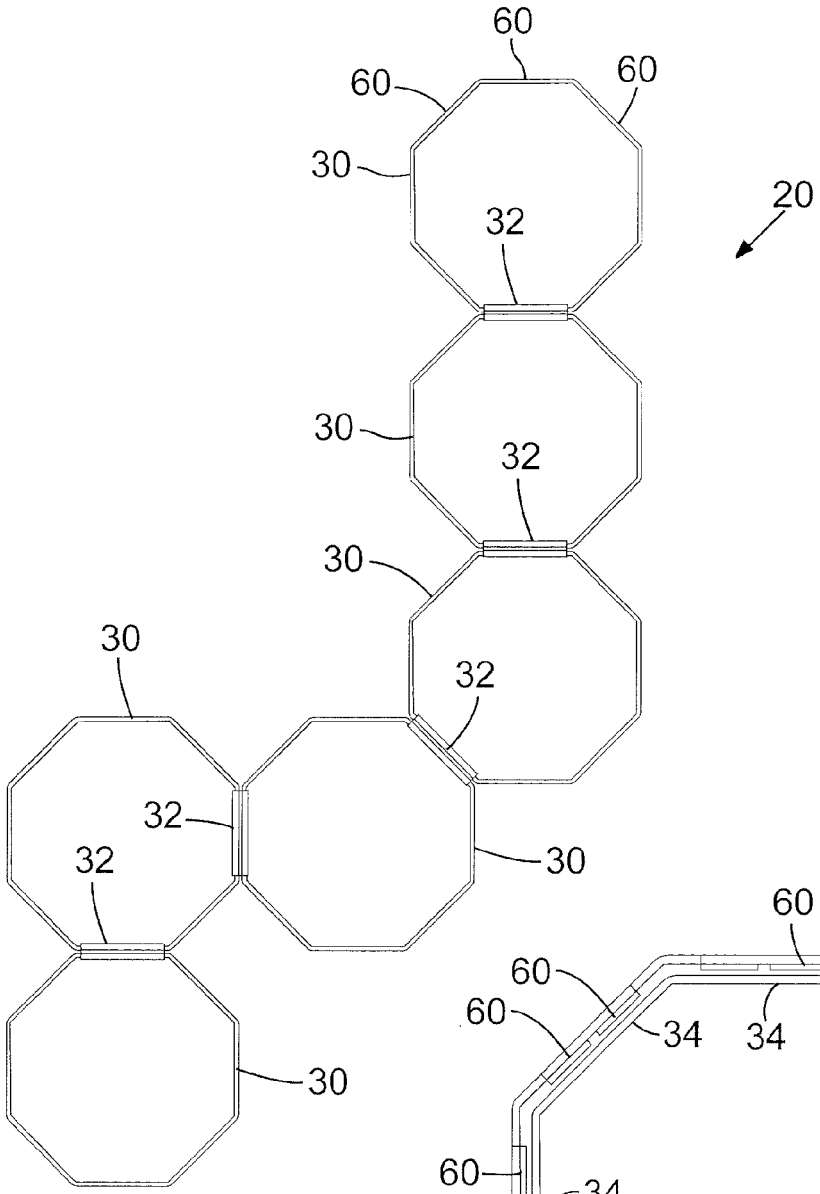
FIG. 3 is a top view of the ladder of FIG. 1 showing a possible second alternative running path configuration.
Figure 4:
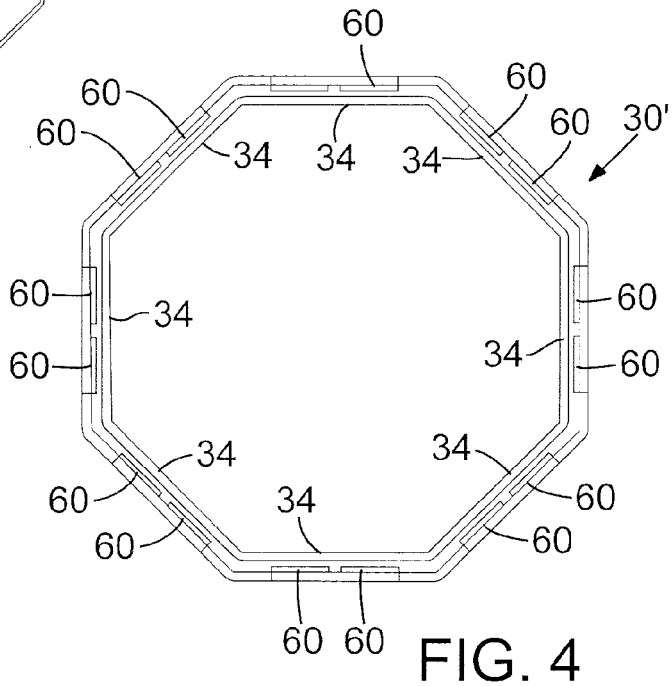
FIG. 4 is a top view of a polygon segment used to form the training ladder of FIG. 1 in accordance with an embodiment of the present invention.
Figure 5:
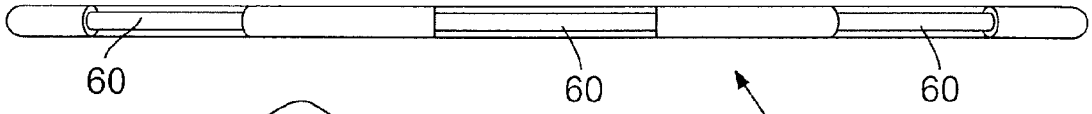
FIG. 5 is a side view of the polygon segment of FIG. 4.
Figure 6:
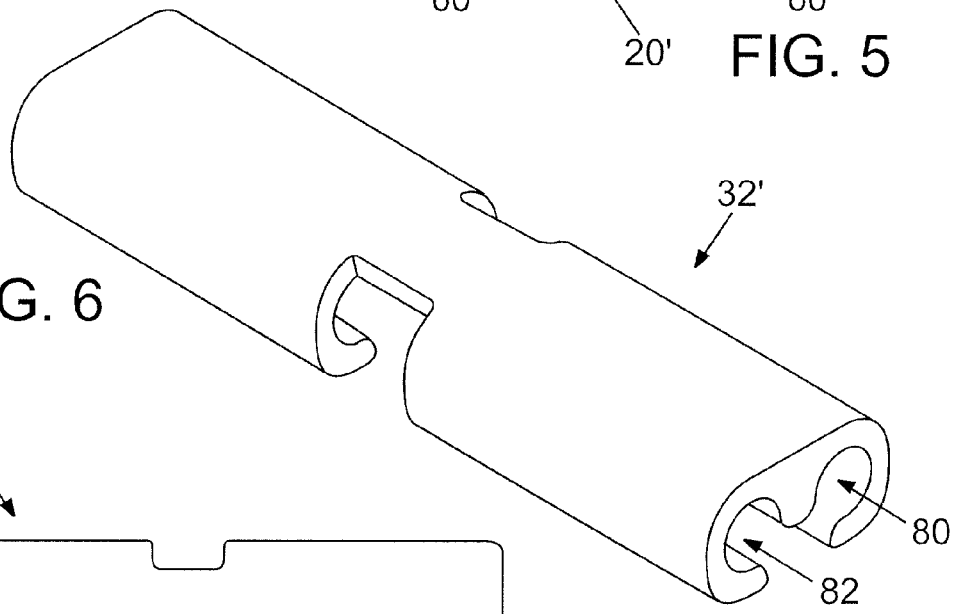
FIG. 6 is an isometric view of a possible segment connector in accordance with an embodiment of the present invention.
Figure 7:
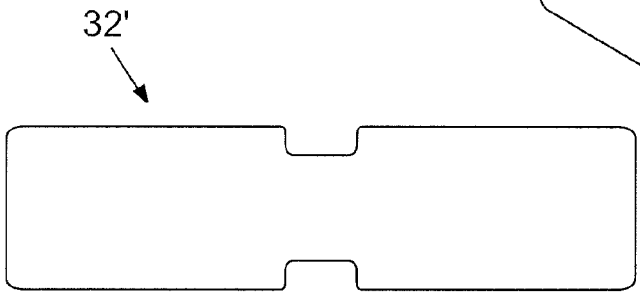
FIG. 7 is a top view of the segment connector of FIG. 6.
Figure 8:
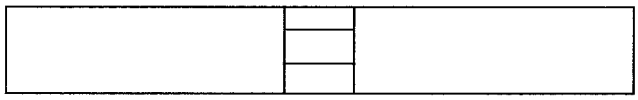
FIG. 8 is a side view of the segment connector of FIG. 6.
Figure 9:
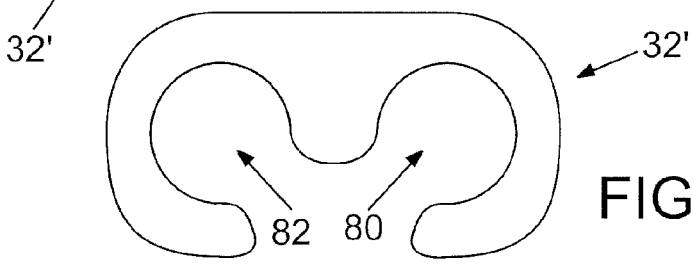
FIG. 9 is a front view of the segment connector of FIG. 6.
Figure 10:
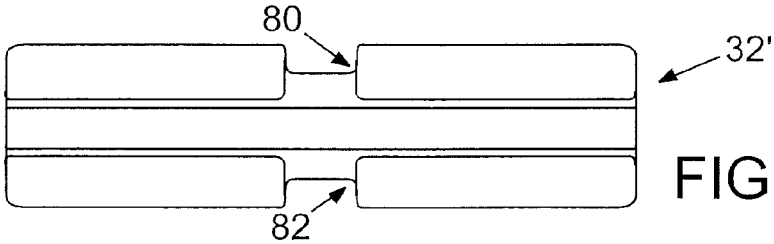
FIG. 10 is a bottom view of the segment connector of FIG. 10.

The ladder may be assembled by joining a plurality of segments 30' together along adjacent sides 34. It can be appreciated that the individual segments can be placed in a variety of positions with respect to each other and then joined together with segment connectors to define a variety of training paths. One possible training path is shown in FIG. 3.

If desired, rubberized feet (not shown) or the like can be placed on a bottom surface of each segment connector to hold the ladder in place when placed on a slippery surface such as a gym floor or the like.

Having described and illustrated the principles of our invention with reference to a preferred embodiment thereof, it will be apparent that the invention can be modified in arrangement and detail without departing from such principles. Accordingly, in view of the many possible embodiments to which the principles may be put, it should be recognized that the detailed embodiments are illustrative only and should not be taken as limiting the scope of our invention. Accordingly, we claim as our invention all such modifications as may come within the scope and spirit of the following claims and equivalents thereto.

What is claimed is:

1. A collapsible athletic training ladder comprising:

a plurality of substantially rigid polygon-shaped segments, each defining an outer perimeter and an interior hollow region; and a plurality of segment connectors each configured to be selectively pivotably secured to a first side, a second side, or a third side that is adjacent to the first side of the plurality of segments to selectively place the training ladder in a first, a second, and a third configuration;

wherein at the first configuration, a first segment connector of the plurality of connectors is configured to pivotably secure a first side of a first segment with a first side of a second segment and a second segment connector of the plurality of connectors is configured to piviotably secure a second side of the second segment with a first side of a third segment of the plurality of segments of the athletic training ladder such that the first, second and third polygon-shaped segments define a first running pattern in a first direction along a substantially horizontal plane parallel with a horizontal bottom surface;

wherein at the second configuration, the first segment connector is configured to pivotably secure the first side of the first segment with a third side adjacent to the first side of the second segment and the second segment connector is configured to pivotably secure the second side of the second segment with the first side of the third segment, such that the first, second, and third polygon-shaped segments define a second running pattern in which a portion of the second running pattern formed from the first and the second segments extends a second direction divergent from the first direction along the substantially horizontal plane parallel with the horizontal bottom surface; and wherein at either the first configuration or the second configuration, said first and second segment connectors are configured to be pivotally secured to said first, second and third segments in a manner allowing the first, second and third segments to be pivoted about said respective segment connectors to permit the ladder to be configured in a third configuration in which the first segment is configured to rest on top of said second segment and the second segment is configured to rest on top of the third segment, thereby defining a collapsed stack of said first, second, and third segments.

2. The collapsible athletic training ladder of claim 1, wherein the plurality of segments comprises at least a third substantially rigid segment and a second segment connector configured to operably engage a plurality of sides of the second segment with a plurality of sides of the third segment, thereby allowing said path through said ladder to be changed by the athlete selecting which sides of the second and third segments to operably engage said segment connectors along the horizontal plane.

3. The collapsible athletic training ladder of claim 1, wherein said first substantially rigid polygon-shaped segment is an octagon defining eight sides having substantially the same length.

4. The collapsible athletic training ladder of claim 3, wherein said segment connector is operably securable to all said eight sides of said first substantially rigid polygon-shaped segment.

5. The collapsible athletic training ladder of claim 3, wherein said second substantially rigid polygon-shaped segment is an octagon defining eight sides having substantially the same length.

6. The collapsible athletic training ladder of claim 5, wherein said segment connector is operably securable to all said eight sides of said second substantially rigid polygon-shaped segment.

7. The collapsible athletic training ladder of claim 1, wherein said segment connector is integrally molded.

8. The collapsible athletic training ladder of claim 2, wherein each segment connector has a first segment engaging portion configured to operably engage any one of a plurality of sides of the first segment and a second segment engaging portion configured to operably engage any one of a plurality of sides of another substantially rigid polygon shaped segment.

9. The collapsible athletic training ladder of claim 1, wherein upon being positioned at the first configuration, a side of said first substantially rigid polygon-shaped segment is selectively rotatably engaged with the first segment connector such to be pivoted about said first segment connector to a position substantially perpendicular to said second segment, in a third configuration thereby defining a hurdle.

10. The collapsible athletic training ladder of claim 9, wherein the plurality of segments comprise at least a first, second, third, and fourth substantially rigid polygon-shaped segments pivotally secured to segment connectors thereby allowing said first, second, third, and fourth substantially rigid polygon-shaped segments to be pivoted on top of each other to define a stack of said first, second, third, and fourth substantially rigid polygon-shaped segments.

11. The collapsible athletic training ladder of claim 10, wherein said second and third segments are pivoted about said segment connectors to rest substantially perpendicular to said first and fourth segments, thereby defining a hurdle.

* * * * *